US006800851B1

(12) United States Patent
Zubarev et al.

(10) Patent No.: US 6,800,851 B1
(45) Date of Patent: Oct. 5, 2004

(54) ELECTRON-ION FRAGMENTATION REACTIONS IN MULTIPOLAR RADIOFREQUENCY FIELDS

(75) Inventors: Roman Zubarev, Sigtuna (SE); Frank Kjeldsen, Uppsala (SE); Igor Ivonin, Uppsala (SE); Oleg Silivra, Uppsala (SE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 10/644,648

(22) Filed: Aug. 20, 2003

(51) Int. Cl.[7] ..... H01J 39/34
(52) U.S. Cl. ..... 250/292; 250/293
(58) Field of Search ..... 250/292, 293, 250/290

(56) References Cited

U.S. PATENT DOCUMENTS 3,937,955 A * 2/1976 Comisarow et al. ..... 250/283

OTHER PUBLICATIONS

Zubarev, Roman A., "Reactions of Polypeptide Ions With Electrons In The Gas Phase", Mass Spectrometry Reviews, vol. 22, Wiley Periodicals, Inc., 2003, pp. 57–77.

Zubarev, Roman A. et al., "Electron Capture Dissociation of Multiply Charged Protein Cations. A Nonergodic Process", Journal of the American Chemical Society, vol. 120, Mar. 24, 1998, pp. 3265–3266.

Haselmann, Kim F. et al., "Advantages of External Accumulation for Electron Capture Dissociation in Fourier Transform Mass Spectrometry", Analytical Chemistry, vol. 73, May 24, 2001, pp. 2998–3005.

Horn, David M. et al., "Automated de novo sequencing of proteins by tandem high–resolution mass spectrometry", PNAS, vol. 97, No. 19, Sep. 12, 2000, pp. 10313–10317.

Kjeldsen, Frank et al., "Dissociative capture of hot (3–13 eV) electrons by polypeptide polycations: an efficient process accompanied by secondary fragmentation", Chemical Physics Letters, vol. 356, Elsevier Science B.V., 2002, pp. 201–206.

Budnik, Bogdan A. et al., "Electron detachment dissociation of peptide dianions: an electron–hole recombination phenomenon", Chemical Physics Letters, vol. 342, Elsevier Science B.V., 2001, pp. 299–302.

* cited by examiner

*Primary Examiner*—Kiet T. Nguyen

(57) ABSTRACT

The present invention relates to ion fragmentation techniques by electron-ion reactions in multipolar radiofrequency fields like those in quadrupole ion traps or in ion guides, and devices to perform ion fragmentation by such techniques. The fragmentation techniques are useful for tandem mass spectrometry. The invention consists of the application of a magnetic field essentially parallel to the axis of the radiofrequency field to confine the electrons in the direction perpendicular to the magnetic field.

20 Claims, 2 Drawing Sheets

ELECTRON-ION FRAGMENTATION REACTIONS IN MULTIPOLAR RADIOFREQUENCY FIELDS

FIELD OF INVENTION

The present invention relates to ion fragmentation techniques by electron-ion reactions in multipolar radiofrequency fields like those in quadrupole ion traps or in ion guides, and devices to perform ion fragmentation by such techniques. The fragmentation techniques are useful for tandem mass spectrometry.

BACKGROUND OF THE INVENTION

Mass spectrometry is an analytical technique by which ions of sample molecules are produced and analyzed according to their mass-to-charge (rnz) ratios. The ions are produced by a variety of ionization techniques, including electron impact, fast atom bombardment, electrospray ionization (ESI) and matrix-assisted laser desorption ionization (MALDI). Analysis by m/z is performed in analysers where the ions are either trapped for a period of time or fly through towards the ion detector. In the trapping analysers, such as quadrupole ion trap (Paul trap) and ion cyclotron resonance (ICR cell or Penning trap) analysers, the ions are spatially confined by a combination of magnetic, electrostatic or alternating electromagnetic fields for a period of time typically from about 0.1 to 10 seconds. In the transient-type analysers, such as magnetic, quadrupole filter and time-of-flight analysers, the residence time of ions is shorter, in the range of about 1 to 100 $\mu$s.

Tandem mass spectrometry is a general term for mass spectrometric methods where sample ions of desired mass-to-charge are selected and dissociated inside the mass spectrometer and the obtained fragment ions are analyzed according to their mass-to-charge ratios. Dissociation of mass-selected ions can be performed in a special cell between two rnz analysers. The cell is usually based on a multipole, i.e. quadrupole, hexapole, etc. ion guide. In trapping instruments, dissociation occurs inside the trap. Tandem mass spectrometry can provide much more structural information of the sample molecules.

To fragment ions inside the mass spectrometer, collisionally-induced dissociation (CID) is most commonly employed. In the predominant technique, the m/z-selected ions collide with gas atoms or molecules, such as e.g. helium, argon or nitrogen, with subsequent conversion of the collisional energy into internal energy of the ions. Alternatively, ions may be irradiated by infrared photons (infrared multiphoton dissociation, IRMPD), which also leads to the increase of the internal energy. Ions with high internal energy undergo subsequent dissociation into fragments, one or more of which carry electric charge. The mass and the abundance of the fragment ions of a given kind provide information that can be used to characterize the molecular structure of the sample in question.

Both collisional and infrared dissociation techniques have serious drawbacks. Firstly, low-energy channels of fragmentation dominate, which can reduce the multiplicity of bond cleavages and thus the fragmentation-derived information. Even at relatively low energy CID conditions "weakly" bonded functional groups are easily detached and therefore structural information can be limited. The presence of easily detachable groups results in the loss of information on their location. Finally, both collisional and infrared dissociations become ineffective for large molecular masses.

To at least partially overcome these problems, a number of ion-electron dissociation reactions has recently been proposed (see review Zubarev, Mass Spectrom. Rev. 22 (2003) 57–77). One of such reactions is electron capture dissociation (ECD) (Zubarev, Kelleher and McLafferty, J. Am. Chem. Soc. 120 (1998) 3265–3266).

The ECD technique is technically related but physically different from earlier work of using high-energy electrons to induce fragmentation by collisions with electrons (Electron Impact Dissociation, EID). U.S. Pat. No. 4,731,533 describes the use of high-energy electrons (about 600 eV) that are emitted radially on an ion beam to induce fragmentation. Similarly, U.S. Pat. No. 4,988,869 discloses the use of high-energy electron beams 100–500 eV, transverse to a sample ion beam to induce fragmentation. The method suffers from low efficiency, with a maximum fragmentation efficiency for parent ions of about 5%.

In contrast to EID, in the ECD technique positive multiply-charged ions dissociate upon capture of low-energy (<1 eV) electrons in an ion cyclotron resonance cell. The low-energy electrons are produced by a heated filament, or by a dispenser cathode (Zubarev et al., Anal. Chem. 73 (2001) 2998–3005). Electron capture can produce more structurally important cleavages than collisional and infrared dissociations. In polypeptides, for which mass spectrometry analysis is widely used, electron capture cleaves the N-$C_a$ backbone bonds (so called c or z type fragmentation), while collisional and infrared excitation cleaves the amide backbone bonds (peptide bonds, so called b or y type fragmentation). Combination of these two different types of cleavages provides additional sequence information (Horn, Zubarev and McLafferty, Proc. Natl. Acad. Sci. USA, 97 (2000) 10313–10317). Moreover, disulfide bonds inside the peptides that usually remain intact in collisional and infrared excitations, fragment specifically upon electron capture. Finally, some easily detachable groups remain attached to the fragments upon electron capture dissociation, which allows for determination of their positions. This feature is especially important in the analysis of post-translational modifications in proteins and peptides, such as phosphorylation, glycosylation, y-carboxylation, etc.

Other ion-electron fragmentation reactions also provide analytical benefits. Increasing the electron energy to 3–13 eV leads to hot-electron capture dissociation (HECD), in which electron excitation precedes electron capture. The resulting fragments undergo secondary fragmentation, which allows for distinguishing between the isomeric leucine and isoleucine residues (Kjeldsen, Budnik, Haselmann, Jensen, Zubarev, Chem. Phys. Lett. 356 (2002) 201–206). In electron detachment dissociation (EDD) (Budnik, Haselmann and Zubarev, Chem. Phys. Lett. 342 (2001) 299–302), 20 eV electrons ionize peptide di-anions, which produces effect similar to ECD. EDD is advantageous for acidic peptides and peptides with acidic modifications, such as sulfation.

The drawback of current ion-electron fragmentation methods lies primarily in that they are only efficient in Penning ion traps, which are not in widespread use due to their cost and technical complexity. In the much more widespread Paul traps, multipole collisional cells and ion guides, the radiofrequency (rf) electric field with the typical amplitude of 500 V and frequency of 1 MHz rapidly deflects the electrons or increases their energy above the region of 20 eV, below which the ion-electron reactions are most efficient. Another difficulty is the parasitic ionization of the background gas molecules that produces large amounts of undesirable ions of both polarities, preferentially positive.

These ions are detected both directly and indirectly via ion-molecule reactions, which in both cases leads to abundant background and parasitic peaks, and thus limits the sensitivity. For helium that is most often used as a buffer gas, parasitic ionization occurs at electron energies exceeding 24 eV. Because of the low efficiency and high background, ion-electron reactions are not implemented on most analytical mass spectrometers.

For these reasons, it would be desirable to improve the efficiency of ion-electron reactions in mass spectrometric devices that utilize rf electric field.

SUMMARY OF THE INVENTION

The present invention provides devices and methods for producing effective ion-electron fragmentation reactions of positive and negative ions in multipolar radiofrequency fields used for storage and transportation of ions. An electron cloud is provided in the center of the field with kinetic electron energies below 20 eV, confined in radial direction by a magnetic field along the axis of the device.

In three-dimensional Paul ion traps with ring and end cap electrodes, the electrons are confined in radial direction by the magnetic field, and in axial direction by the electrical potential during a half period of the radiofrequency voltage; and means are provided for trapping the electrons in the direction along the axis of the device when the value of the radiofrequency voltage is positive. The electron cloud in the center can be provided at least once during every period of the radiofrequency, thus the duty cycle for ion-electron reactions can be 50% or higher.

In two-dimensional multipole field devices, like linear traps or ion guides, the magnetic confinement of the electrons in radial direction does not need to be supported by a confinement of the electrons in axial direction. The low kinetic energy electrons may freely drift along the axis of the device, or may be confined by a suitable force field like, e.g., a magnetic bottle.

Since the axial magnetic field prevents radial acceleration of the electrons by the radiofrequency voltage in both types of radiofrequency devices, the electrons essentially retain their initial kinetic energy during a significant part of the trapping period, and interact efficiently with the ions.

DETAILED DESCRIPTION

Figure 1:
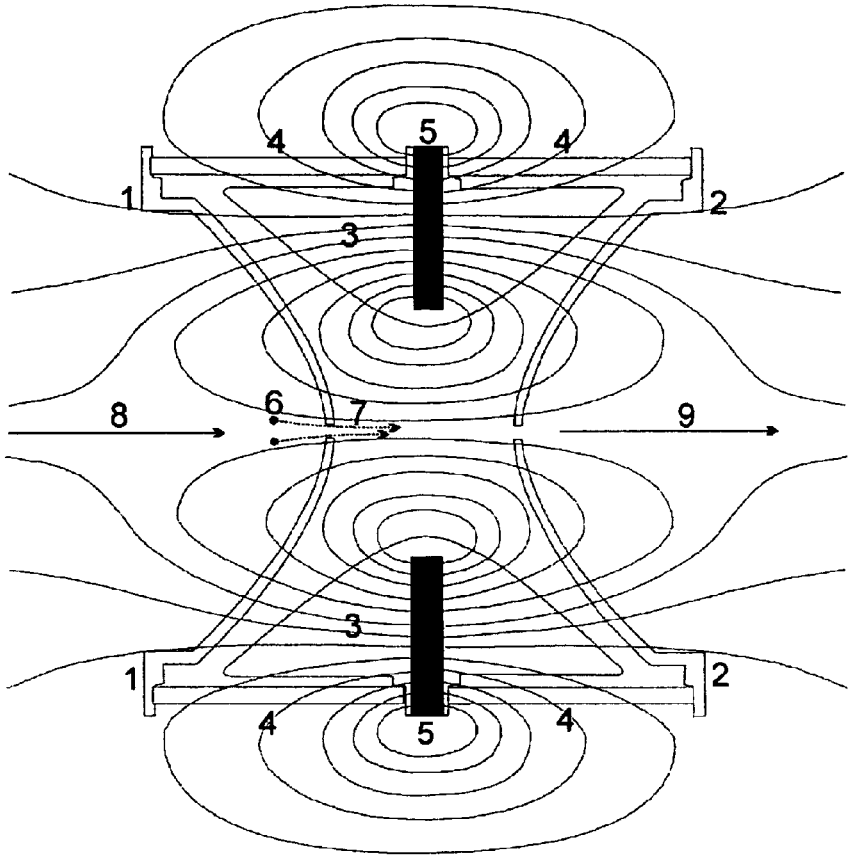
FIG. 1 exhibits a Paul ion trap with a single, washer-shaped permant magnet (5) within the ring electrode (3) to guide electrons from a ring-shaped emitter (6) into the ion trap.

The method of the invention of obtaining efficient ion-electron reactions for use in mass spectrometry comprises the steps of:

providing a multipolar (at least quadrupolar) electric radiofrequency field capable to store or guide ions for at least some period of time;

providing positive or negative ions in a spatially limited region within that radiofrequency field;

providing an electron cloud inside said region with electron energies below approximately 20 eV, to allow ion-electron reactions;

and providing a magnetic field inside said region sufficiently strong to confine the motion of said electron cloud in the direction perpendicular to said magnetic field.

The spatially limited region is typically within a mass spectrometer, or in an adjacent space such as a reaction chamber or a region of an ionization source, where sample ions are stored or guided through such that they are located within the region for a period of time to interact with an electron beam.

There are at least two types of radiofrequency devices capable to provide storing or guiding of ions: Linear rod systems with radiofrequency voltages applied to the rods, storing or guiding ions in the axis of the rod system, and rotationally symmetric ring and endcap systems with radiofrequency voltages applied to the ring and endcap electrodes, storing ions in the center of the system. Widely used are rod systems with four rods producing a two-dimensional quadrupolar field within the system, and Paul ion traps with one ring and two endcap electrodes essentially producing a three-dimensional quadrupole field. Both types of devices offer temporal and/or spatial windows to feed low energy electrons into the center of the field where the ions are confined. In this context, the notion "center" refers to the central axis in two-dimensional multipole fields, and to the central point in three-dimensional multipole fields.

In linear radiofrequency rod systems, low energy electrons may be fed exactly into the axis of the system in the form of a spatially very fine beam. Exactly in the axis, the field strength is perpetually zero, with a potential in form of a saddle. The saddle is fluctuating in strength and direction with the frequency of the radiofrequency voltage. The electrons in the axis are in a state of perpetuous unstable balance. In practice, it is impossible to keep the electrons in balance without the inventive step of providing a sufficiently high magnetic field parallel to the axis confining the electrons in the axis. For reaction with the ions, the electrons may freely drift through the axis, or they may be confined by field forces, for instance, by a magnetic field forming a so-called bottle with higher field strengths at the ends of the rod system.

In a Paul ion trap, low energy electrons may be fed into the system through one of the end caps in the exact moment of zero field conditions inside the ion trap, or in a moment just before the field vanishes, but already in the next moment the electrons are in a severely unstable state within the quadrupole field increasing with progressing phase of the radiofrequency. Also here, they can be kept inside the trap by an axial magnetic field of sufficient strength. When low energy electrons are fed to the center of the trap in the exact moment in which the voltage at the ring electrode passes from negative to positive value with respect to the voltage at the end cap electrodes, the electrons are, in the next moment, exposed to an unstable drain, being positioned on a rounded potential hill, towards the surrounding ring electrode but can be kept in place by the magnetic field. In the direction towards both end caps, the electric field is becoming increasingly repelling so that the electrons remain stored within the Paul trap for at least half a period of the radiofrequency voltage.

Means may be provided for production of electrons outside or inside the spatially limited region such as thermoemission from a hot surface, field emission, secondary electron emission or photoemission from a surface or gas-phase molecules. The production of electrons may be continuously or in the form of temporal pulses.

A force field may suitably be used to assist in directing and guiding the electrons produced outside the spatially limited region into said region, such as a magnetic field, an electric field, an electromagnetic field, or any combination thereof.

Means may be provided to gate the beam of electrons timewise by a shutter, and to synchronize and lock the gating pulses to the phase of the radiofrequency voltage.

Means may be provided for damping the motion of electrons and ions, both precursor and fragment, inside the spatially limited region, such as buffer gas. The buffer gas may be continually applied or in form of gas pulses.

The magnetic field may be created by a permanent magnet or electromagnet, including resistive and superconducting magnets. The field configuration may be homogeneous or inhomogeneous, including in the shape of a magnetic bottle.

The method of the invention for providing ion-electron reactions of sample ions will in useful embodiments cause them to dissociate to provide fragment ions. Electron detachment dissociation (EDO) utilises the following ion-electron reaction:

$$[M-.nH]^{n-}+e-\rightarrow[M-nH]^{(n-1)-\cdot}+2e-\rightarrow\text{fragmentation}$$

where multiply-deprotonated molecules $[M-nH]^{n-}(n\geqq 2)$ are provided, most suitably by electrospray ionization. (The parent ion needs to have a charge of 2 or higher, to obtain at least one charged fragment after ejection of an electron wherein the negative charge is decreased by one unit charge). The cross section of electron detachment reaches appreciable values above 10 eV and maximum values around 20 eV, and therefore for effective reaction the electrons (or a substantial portion thereof) should preferably have kinetic energies between 10 and 20 eV, more preferably between 17 and 20 eV.

Electron capture dissociation (ECO) utilises the following ion-electron reaction:

$$[M+nH]^{n+}+e-\rightarrow[M+nH]^{(n-1)+\cdot}\rightarrow\text{fragmentation}$$

where multiply-deprotonated molecules $[M+nH]^{n+}(n\geqq 2)$ are provided, most suitably by electrospray ionization. (The parent ion needs to have a charge of 2 or higher, to obtain at least one charged fragment after capture of an electron whereby the positive charge is decreased by one unit charge.) The cross section of electron capture rapidly decreases with electron energy, and therefore for effective reaction the electrons (or a substantial portion thereof) should preferably have kinetic energy below about 1 eV, more preferably below about 0.5 eV, and more preferably about 0.2 eV or less. The cross section of electron capture is also quadratically dependent upon the ionic charge state, meaning that capture by doubly charged ions is four times more efficient than by singly-charged ions. Therefore, the less charged fragments formed from the parent ions capture electrons with a much lower rate compared with the parent ions.

In hot electron capture dissociation (HECD), the electrons should have energy in the range between 3 and 13 eV, more preferably around 11 eV. Such hot electrons are captured directly and simultaneously produce electronic excitation. The excess energy in HECD is typically dissipated in secondary fragmentation reactions, such as losses of H. and larger radical groups near the position of primary cleavage.

Ions suitably analyzed with the current invention include many different classes of chemical species that can be ionized to provide multiply charged ions, e.g. polymers, carbohydrates, and biopolymers, in particular proteins and peptides, including modified proteins and peptides.

It is postulated herein that contrary to what has been suggested by the prior art, that even in Paul traps an electron cloud of sufficiently low energy can be provided inside the device during the positive phase of the rf voltage during which the electric field is trapping the electrons in one direction, and the magnetic field will trap the electrons in two other directions, which will result in trapping of the electron cloud in the device for a period of time comparable with the duration of the positive phase of the rf voltage, and the kinetic energy of the electrons will remain sufficiently low during a significant fraction of the trapping period.

A preferred embodiment using a widely conventional Paul ion trap is shown in FIG. 1. The two end cap electrodes (1) and (2) and a ring electrode (3) are held in exact distance by electrically isolating ring spacers (4). The ring electrode (3) holds a permanent magnet (5) in the form of a big washer, glued into a groove in the ring (3) in form of two half washers. The disk-shaped magnet (5) with central hole forms a complicated magnetic field, the field lines are outlined in the drawing. The axial magnetic field in the center of the ion trap opens slightly outside the end cap electrodes (1) and (2), allowing to feed near axis electrons into the trap from a ring-shaped cathode emitter (6) surrounding the axis. The way of the electrons is outlined by paths (7). The opening in the ring-shaped cathode (6) allows ions to be fed in direction (8) through the ring-shaped cathode into the trap, and being caught there by usual means. If the voltage between cathode (6) and end cap electrode (1) is pulsed in such a way, that electrons are only allowed to enter the trap shortly before zero field conditions, a cloud of electrons can be brought to stop exactly in the center of the trap in exactly the moment of zero field conditions. If the potential in the center is on its way to more positive voltage values, the cloud of electrons is then confined in this potential well for the next half period of the radiofrequency voltage and will not take up energy during this period of time. The low-energy electrons can then react with the ions stored here. The resulting reaction product ions can be analyzed in the usual way by mass-selective ejection of the ions out of the trap in the direction (9) towards an ion detector.

Figure 2:
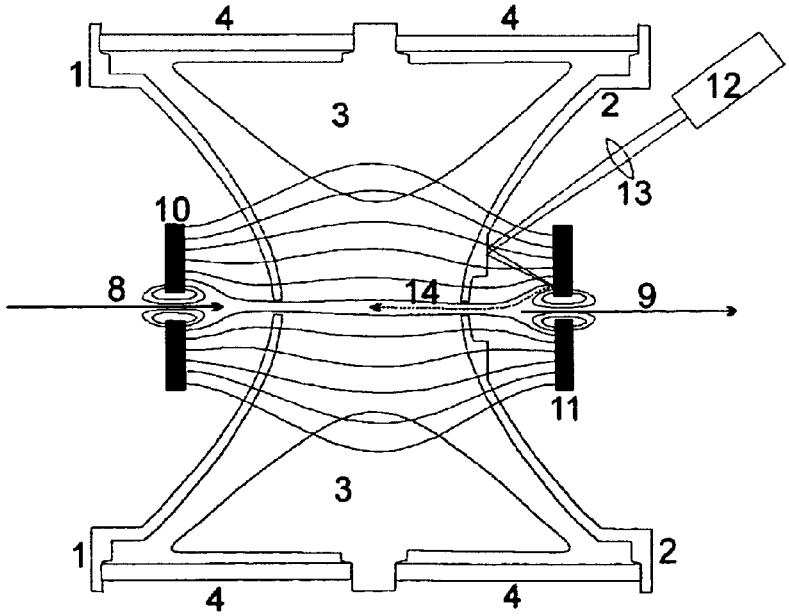
FIG. 2 shows a Paul ion trap with a nanosecond ultraviolet pulse laser (12) for electron generation and two washer-shaped magnets (10, 11) for the guidance of the electrons along path (14) into the ion trap.

Another preferred embodiment applies two washer-like permanent magnets (10) and (11), as outlined in FIG. 2. The ions may be fed in direction (8) through these magnets into the ion trap. Electrons may here also be, as in FIG. 1, generated by a ring-shaped cathode emitter and be fed near axis into the ion trap. However, in FIG. 2 another method of electron generation is presented: a nanosecond ultraviolet pulse laser 12 generates an ultraviolet light beam pulse which is focused by a lens 13 onto a thoroughly tuned position of the electrically conducting magnet surface. A cloud of up to a few thousand electrons is generated here and guided by a magnetic field line (14) into the ion trap driven by a small potential applied to the magnet. The laser pulse is timed in such a way that the electrons, entering the ion trap, still see a small (negative) potential hill which they have to climb, thereby losing energy. Correct timing will result in a rest of the electrons, with zero kinetic energy, exactly at the top of the potential hill among the ions which are stored here. The hill potential is rapidly shrinking with progressing radiofrequency phase. A few nanoseconds later the potential hill disappears and changes into a potential well, wherein the electrons are captured for a half period of the radiofrequency voltage, ample time to react with the ions in the ion cloud.

Other preferred embodiments apply electromagnets, e.g., a coil around the ring electrode, or two coils hidden in the free space of both the end cap electrodes.

Figure 3:
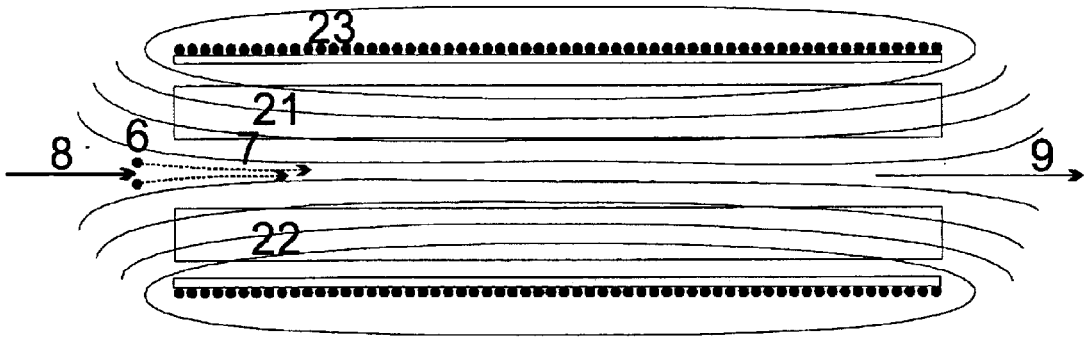
FIG. 3 shows a linear radiofrequency quadrupole ion guide surrounded by an electromagnet (23) for guiding electrons from an ring-shaped emitter (6) into a near-axis path of the ion guide.
Figure 4:
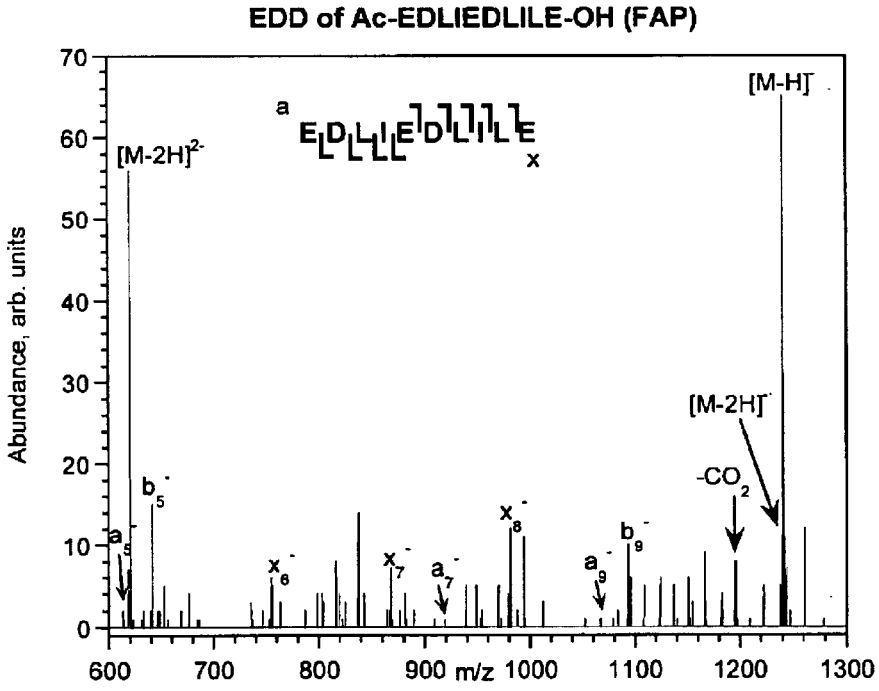
FIG. 4 presents a mass spectrum of electron detachment dissociation (EDD) of doubly negatively charged ions of FAP peptide obtained in a Paul ion trap.

The use of an electromagnetic coil (23) is presented in FIG. 3, this time for a quadrupolar ion guide with four straight rods, with only two opposing rods (21) and (22) are being visible in FIG. 3. The ions are brought into the axis of the system along direction (8) through a ring-shaped cathode emitter which adds low-energy electrons to the slow ion beam. The electrons can react with the ions during the drift time inside the ion guide, before the ions are extracted in direction (9).

The magnets, whether permanent or electromagnets, can be supported by yokes. The magnetic field can be shielded not to reach the ion detector, which sometimes reacts negatively in the presence of magnetic fields. Electromagnets and permanent magnets can be mixed to form favorable field conditions. Computer simulations have revealed that weak magnetic fields in the order of 100 Gauss suffice to confine the electrons in the center of the multipolar radiofrequency field.

Electrons may be generated by hot cathodes which may be metallic emitters or dispenser cathodes. The cathodes may be ring-shaped, or consist only of one or two wires formed straight or V-shaped. Field emitters may be used to deliver electrons, or photo electrons may be released from suitable emitter surfaces by light pulses of sufficient energy. Between emitter and end cap electrodes, other particle-optical means may be located such as electron lenses to accelerate, guide, and gate the electron beam.

Although the concept of ion-electron fragmentation reactions is not novel per se, as discussed above, the prior art fails to provide techniques for effectively obtaining this objective in other types of instrumentation than ion cyclotron resonance mass spectrometers.

The present invention reaches this objective by utilizing the property of a compact cloud of charged particles, electrons and ions, to essentially preserve their kinetic energy distribution at the conditions of varying electric potential in the region occupied by the cloud, providing that the gradient of the potential changes is slow compared to the movement of the charged particles. In the center of the mass spectrometric devices, such as Paul traps, linear quadrupole traps and multipole ion guides, the gradient of the electric potential is equal to zero. In the nearby region, which is occupied by the ions, the non-zero gradient changes periodically with the radiofrequency. During half of the period of the radiofrequency, when the value is positive, the conditions in one of the directions are trapping for the electrons residing near the point where the gradient is zero. The change of the voltage occurs at much slower rate than the motion of electrons with the energy exceeding approximately 0.1 eV. Indeed, such electrons have a velocity exceeding 20 cm/$\mu$s, which means that one period of 1 MHz radiofrequency corresponds to at least 10 periods of trapped motion in that direction in a region 1 cm long. The trapped electrons thus adjust to the radiofrequency voltage without gaining from it significant kinetic energy. In the perpendicular direction, the electron motion is confined by the magnetic field, and thus even in that direction the electrons cannot gain energy. The electrons essentially preserve their average kinetic energy as long as the trapping conditions exist. Since trapping conditions exist during the half of every period of the radiofrequency, the duty cycle of ion-electron reactions can be as high as 50%, that is much higher compared to irradiation by constant electron beam as suggested by prior art. Moreover, since the kinetic energy of electrons never exceeds the desired value, parasitic ionization of the background gas and the associated background noise in the mass spectra are avoided by the invention. The suggested combination of the confinement by parallel magnetic field and electric field has never been used before to trap electrons in the region occupied by ions in a radiofrequency mass spectrometry device to produce ion-electron reactions, nor has such use been suggested by the prior art.

The electron cloud used according to the invention can be obtained from either a continuous electron beam, such as produced by a hot filament or dispenser cathode, or a pulsed electron beam, such as produced by photoemission under UV laser irradiation, and this may depend on the type of instrument used. If a continuous electron beam produced outside the trapping device is used, means are applied to inject no this beam in the device only during suitable phases of the rf voltage, so that the electron energy in the region occupied by the ions will have the desired value. Additionally, lenses or grids or similar devices to direct the electrons towards the center of the device can be used.

Alternatively, the electron cloud can be produced inside the device. UV light can be directed from outside the device onto one of the inner surfaces to produce secondary electrons during the suitable phase of the rf voltage. The desorbed secondary electrons can be directed towards the region occupied by the ions by a combination of electric and magnetic fields. The secondary low-energy electrons can be produced inside the trapping device also by ionization of gas-phase molecules, either by UV light or by energetic electrons pulsed during the suitable rf phase.

Although, as discussed above, the trapping of both electrons and ions in the same region will often provide useful ion-electron reactions that will yield fragment spectra, in other advantageous embodiments, additional fragmentation means are applied to dissociate the ions that have reacted with electrons. These species will typically show different fragmentation pattern than the corresponding "pre-ECD" ions with the respective fragmentation techniques, and thus spectra obtained may provide additional information as compared to using only ECD or only the additional fragmentation means. The additional fragmentation means are, e.g., means to provide collisionally activated dissociation, a source of electromagnetic irradiation, in particular such as an infra-red laser, or UV laser, or a source of blackbody radiation.

What is claimed is:

1. A device for performing electron-ion fragmentation reactions comprising:

(a) a multi-electrode structure, (b) a generator delivering radiofrequency voltages to the multi-electrode structure to form an electric multipolar radiofrequency field, (c) an ion source delivering ions into the radiofrequency field, where the ions are confined in a spatially limited region by the radiofrequency field for at least some period of time, (d) a magnetic field source for superimposing a magnetic field on the electric radiofreqency field, and (e) an electron source for providing electrons with energies below approximately 20 electronvolts into said spatially limited region.

2. Device according to claim 1 wherein the multi-electrode structure consists of straight rods.

3. Device according to claim 2 wherein the multi-electrode structure consists of four parallel straight rods.

4. Device according to claim 1 wherein the multi-electrode structure consists of ring and end cap electrodes.

5. Device according to claim 4 wherein the multi-electrode structure consists of one hyperbolicly shaped ring and two hyperbolicly shaped end cap electrodes.

6. Device according to claim 1 wherein the ion source delivers multiply charged ions.

7. Device according to claim 6 wherein the ion source is an electrospray ion source.

8. Device according to claim 1 wherein the ion source comprises an ion selector for selecting ions with respect to their mass-to-charge ratio.

9. Device according to claim 1 wherein an additional generator delivers AC or DC voltages to the multi-electrode structure to eject ions of preselected mass-to-charge ratios.

10. Device according to claim 1 comprising a damping gas source to deliver a damping gas to the multi-electrode structure to damp the motion of the ions and to form a cloud of ions in the center of the multi-electrode structure.

11. Device according to claim 1 wherein the electron source comprises an electron emitter.

12. Device according to claim 11 wherein the electron emitter is located within the magnetic field in such a way that the electrons can reach locations near the center of the multi-electrode structure by following the magnetic field lines.

13. Device according to claim 1 wherein the electron source comprises a voltage generator delivering an acceleration voltage for the electrons.

14. Device according to claim 13 wherein the voltage generator comprises an electron pulser for pulsing the electrons whereby the time of pulses may be locked to the phase of the radiofrequency voltage.

15. Device according to claim 1 wherein the electron source comprises a pulse laser for generating electrons in short pulses.

16. Device according to claim 1 wherein the magnetic field is generated by one or more permanent magnets.

17. Device according to claim 1 wherein the magnetic field is generated by electric current through one or more coils.

18. A method of obtaining efficient ion-electron reactions comprising the steps of:

(a) providing a multipolar electric radiofrequency field for storage or guidance of ions, (b) providing positive or negative ions in a spatially limited region inside the radiofrequency field where the ions are confined at least some period of time;

(c) providing electrons inside said region with kinetic energies of the electrons below approximately 20 eV, to allow ion-electron reactions; and (d) providing a magnetic field inside said region sufficiently strong to confine the motion of said electrons in the direction perpendicular to said magnetic field.

19. The method according to claim 18 wherein a force field assists in directing and guiding the electrons produced outside the spatially limited region into said region.

20. The method according to claim 18 wherein the electrons are provided within a small time window of a few nanoseconds, the time being locked to the phase of the radiofrequency voltage.

* * * * *